United States Patent [19]

Perry et al.

[11] Patent Number: 4,736,773

[45] Date of Patent: Apr. 12, 1988

[54] ELECTRONICALLY SWITCHED PNEUMATIC VALVE SYSTEM

[75] Inventors: William D. Perry; Donald H. Heihn, both of San Antonio, Tex.

[73] Assignee: Nippon Colin Co., Ltd., Komaki, Japan

[21] Appl. No.: 888,740

[22] Filed: Jul. 21, 1986

[51] Int. Cl.[4] ..... F15B 13/043

[52] U.S. Cl. ..... 137/625.64; 137/625.6

[58] Field of Search ..... 137/625.6, 625.64

[56] References Cited

U.S. PATENT DOCUMENTS

| | | | |
|---|---|---|---|
| 2,808,811 | 10/1957 | McLaughlin | 137/625.64 |
| 2,998,026 | 8/1961 | Becker | 137/625.64 X |
| 3,113,590 | 12/1963 | Olson | 137/625.6 |
| 3,385,166 | 5/1968 | Kroffke | 137/625.6 X |
| 3,804,120 | 4/1974 | Garnett | 137/625.64 |
| 4,298,181 | 11/1981 | Corrado et al. | 137/625.64 X |

*Primary Examiner*—Gerald A. Michalsky
*Attorney, Agent, or Firm*—Gary W. Hamilton

[57] ABSTRACT

An electronically actuated switching valve for controlling the flow of gas streams in a pneumatic system. The preferred embodiment of the invention comprises a double piloted three-way spool valve which moves within a valve housing having a plurality of ports which cooperate with the spool valve to direct gas streams in a predtermined manner. The position of the valve spool within the housing is controlled by pressure pilots on either side of the valve spool. Electronically actuated solenoid exhaust valves are operable to cause pressure drops in the pressure pilots to cause the valve spool to change position. Once the valve spool has changed position, it is maintained in that position without the need for a continuous supply of electric current to the electronic actuators.

3 Claims, 3 Drawing Sheets

ELECTRONICALLY SWITCHED PNEUMATIC VALVE SYSTEM

FIELD OF THE INVENTION

The present invention relates generally to the field of pneumatic control systems. More specifically, the present invention provides an efficient, electronically actuated switching valve for controlling the flow of gas streams in a pneumatic system. The system comprises a pair of electrically controlled actuators which require only a short pulse of electric current to cause the switching element to change position. Once the switch has moved to a new position, it is maintained in that position without the need for a continuous supply of electric current.

BACKGROUND

In recent years, there has been an increasing use of miniaturized pneumatic systems for a wide variety of applications. Many of these systems employ readily available miniature cylinders of pressurized gas, such as carbon dioxide, as their source of gas to operate the various system elements. Although the use of small cylinders of compressed gas allows the construction of extremely compact pneumatic systems, such systems are often limited by the relatively small supply of gas contained in these cylinders. The problems associated with the limited supply of gas are exacerbated by the use of inefficient switching valves designed for use on larger pneumatic systems in which the supply of gas is not a serious constraint.

Another consideration in the design of a portable pneumatic switching system is the ability to control the operation of the switch function electronically. Electrically controlled pneumatic systems typically employ a system of solenoid controlled valves which require a constant supply of current to maintain the valve in the desired position. Again, this is not a major concern in larger systems which have readily available sources of power. However, it is a significant constraint in the design of portable systems which will operate the solenoids with batteries.

SUMMARY OF THE INVENTION

The pneumatic valve system of the present invention overcomes the difficulties of previous switching systems by providing an electronically actuated switching valve for use in portable pneumatic systems or in any pneumatic system in which the supply of gas or electric power is a constraint. The preferred embodiment of the invention employs a double piloted three-way spool valve which moves within a valve housing having a plurality of ports which cooperate with the spool valve to direct gas streams in a predetermined manner. The position of the spool valve within the housing is controlled by pressure pilots acting on opposite sides of the spool valve. These pilots are normally in a balanced pressure condition and thus the spool valve is stationary within the housing. Electronically actuated solenoid exhaust valves are operable to cause a pressure drop in either of the pressure pilots to cause the spool valve to move to the opposite position within the housing in response to a pressure differential between the two pilots. In addition to the electronically actuated switching arrangement, the valve housing is provided with an auxiliary port to allow the valve to be moved to the closed position in response to the activation of an external reset valve. This is incorporated as a safety feature to disable the supply of gas in the event that the electrically controlled solenoid exhaust valve should fail.

DETAILED DESCRIPTION OF THE PREFERRED EMBODIMENT

Figure 1:
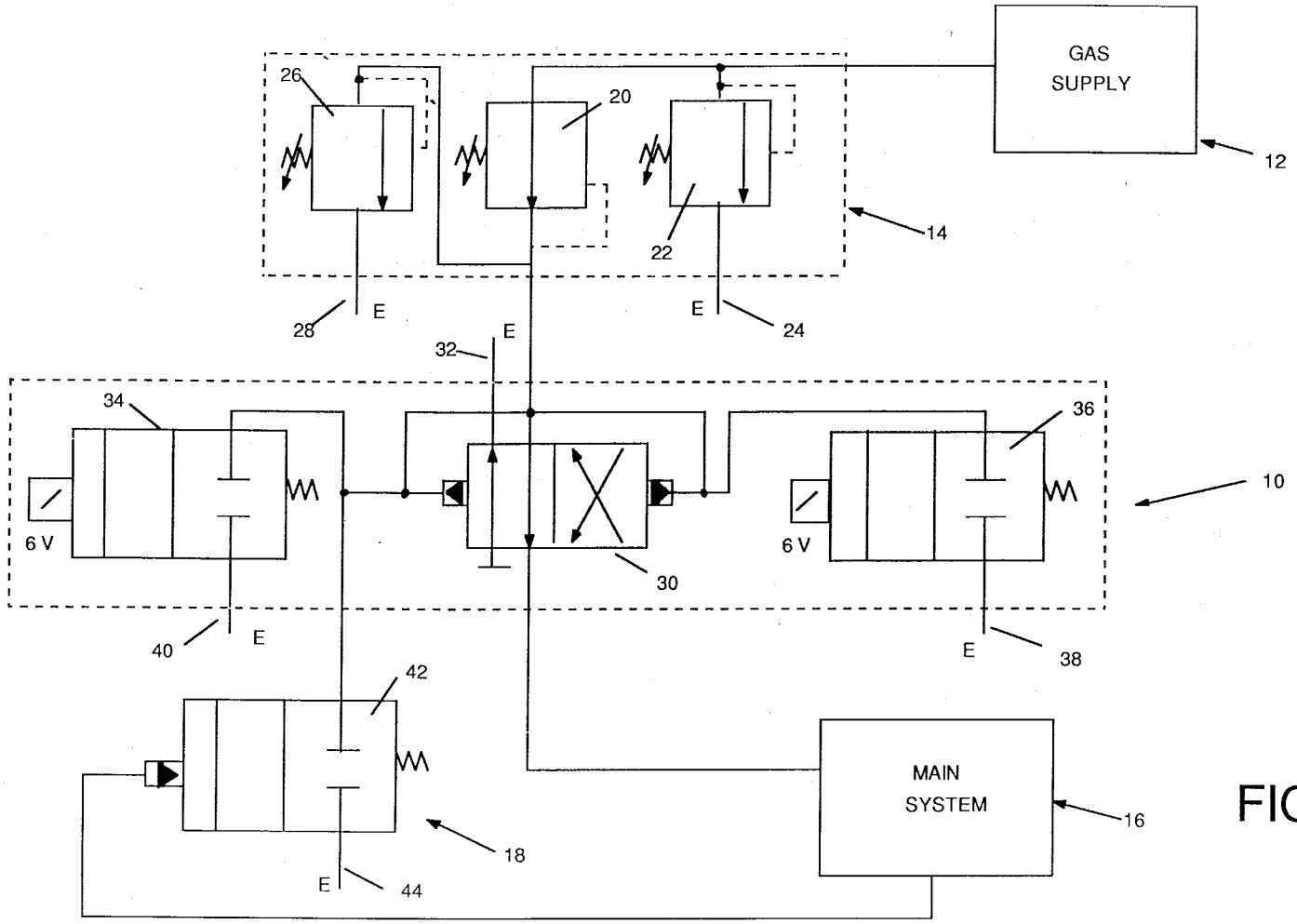
FIG. 1 is a schematic representation of components in a hypothetical pneumatic system utilizing the electronically switched pneumatic valve of the present invention.

Referring to the drawings in more detail and to FIG. 1 in particular, the electronically controlled pneumatic valve assembly 10 of the present invention is shown as an intergral component of a hypothetical pneumatic system. In the preferred embodiment, the gas supply 12 is in the form of a conventional carbon dioxide cylinder. The other system components include a primary regulator 14, the main system 16, and the reset valve assembly 18. The main system 16 is used in this context to represent any of a number of generic pneumatic systems which could be controlled by the invention pneumatic valve 10.

The gas supplied by the carbon dioxide cylinder 12 initially enters the primary regulator module 14 at a pressure of 800 pounds per square inch (psi). In the preferred embodiment, the pressure of the gas stream is reduced to 50 psi by pressure regulator 20 and is then distributed to the valve assembly 10 via an appropriate pneumatic line or system manifold. The primary regulator 14 also contains two pressure relief valves to correct abnormal pressure conditions on either the high pressure side or low pressure side of the regulator 20. A high pressure relief valve 22 is connected to the higher pressure side of the pressure regulator 20 to control the raw pressure of the gas stream provided by the carbon dioxide cylinder 12. This valve is incorporated as a safety feature to relieve excess pressure in the primary regulator. Excess gas is vented from the pressure relief valve 22 via exhaust vent 24. The pressure relief valve 22 used in the preferred embodiment is designed to relieve pressure above 3100 psi. This is approximately the pressure in a typical carbon dioxide cylinder exposed to an ambient temperature of 160° F., and is well below the 6000 psi proof test limit of the cylinder.

The second pressure relief valve 26 is connected to the low pressure side of the regulator 20. This relief valve is adjustable, but in the preferred embodiment it is normally set to relieve pressures above 70 psi, which is above the normal operating pressure. Excess gas is vented from the pressure relief valve 26 via exhaust vent 28.

The 50 psi regulated gas stream from the primary regulator 14 is routed through the system manifold to the invention pneumatic valve assembly 10. The valve assembly 10 comprises a double-piloted, three-way spool valve shown schematically by reference number 30. The pilots 34 and 36 for the spool valve 30 are electrically actuated requiring a 6-volt signal for a maximum of 2 seconds to actuate the spool valve 30 and cause it to change position. Once the spool valve 30 has changed position, no additional electric current is required, and the valve will stay in its new position until the other pilot valve is actuated thus causing the spool valve to change position. The mechanical components which are used to achieve the functional characteristics of the valve assembly will be discussed in greater detail below.

When an appropriate electronic control signal to initiate operation of the system is sent to the valve assembly 10, the spool 30 moves to the "ON" position and allows a 50 psi stream of carbon dioxide gas to flow through the system to the input of the main system 16. The spool valve 30 will remain in the "ON" position until another control signal is sent to the valve assembly to move the valve to the "OFF" position, or until the pressure in the main system reaches a predetermined level, thereby causing the high pressure reset valve assembly 18 to interrupt operation of the system, as discussed below.

An auxiliary pilot port which allows the spool valve 30 to be moved to the "OFF" position is also included in the invention valve assembly 10. This auxiliary pilot port is actuated by the high pressure reset assembly 18. The high pressure reset assembly comprises a piloted relief valve 42 which opens when the output pressure of the main system 16 reaches a predetermined pressure. When the valve opens, pressure from the auxiliary port on the piloted valve assembly 10 is exhausted via exhaust port 32 and the valve is turned to the "OFF" position, thus terminating the flow of gas through the system. The automatic shutdown feature on the high pressure reset valve assembly 18 is entirely independent of the electric power in the system and will function even if the control system or batteries should fail.

Figure 2:
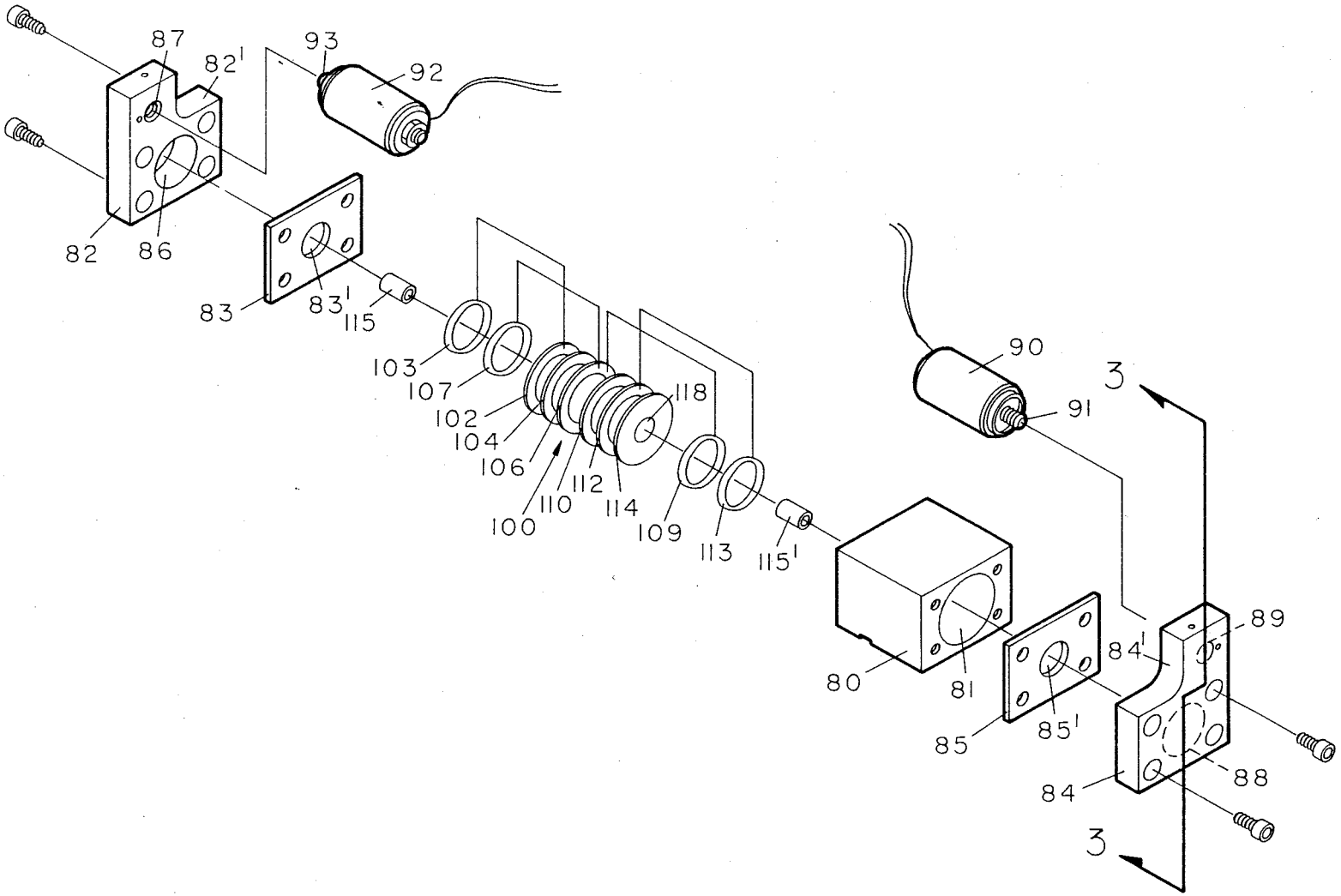
FIG. 2 is an exploded perspective view of the invention valve assembly showing details relating to the three way spool valve assembly and the electronic actuators.
Figure 3A:
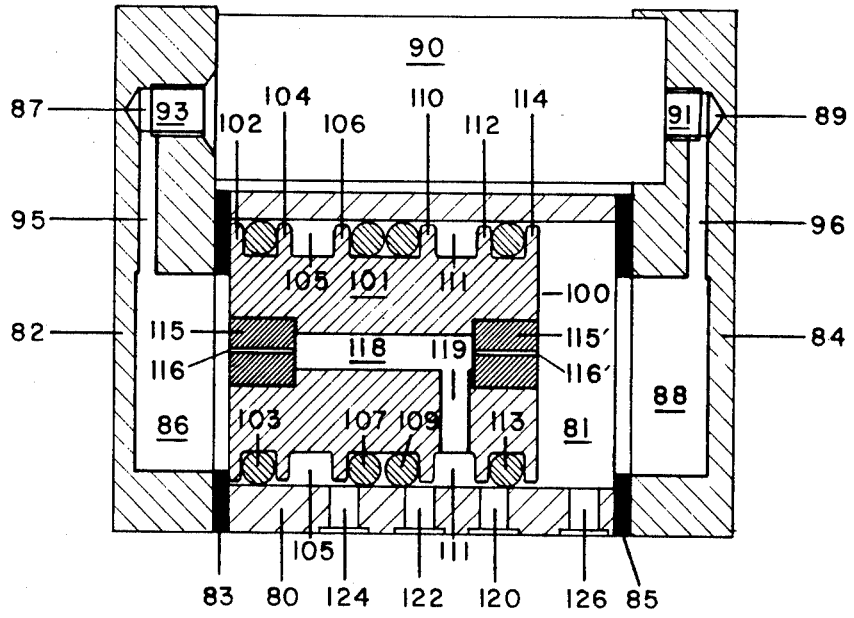
FIG. 3*a* is a cross sectional view of the invention valve assembly taken along section lines 3—3 of FIG. 2 showing details relating to the distribution of gas streams with the three way spool valve in the "OPEN" position.
Figure 3B:
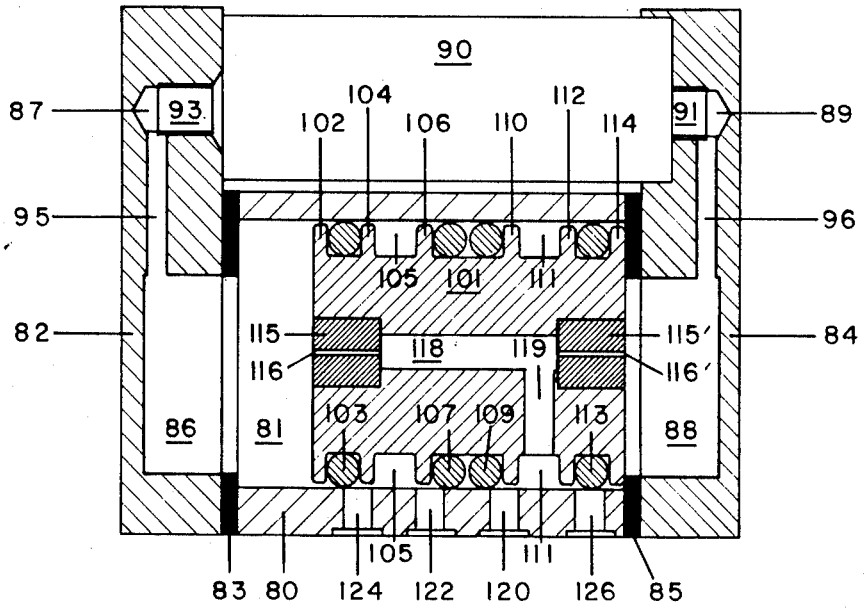
FIG. 3*b* is a cross sectional view of the main valve assembly taken along section lines 3—3 of FIG. 2 showing details relating to the distribution of gas streams with the three way spool valve in the "CLOSED" position.

Details relating to the invention valve assembly 10 can be seen by referring to the exploded diagram of the assembly, shown in FIG. 2, and to the cross sectional diagrams shown in FIGS. 3*a* and 3*b*. The central valve body 80 consists of an elongated cube having a central disposed longitudinal bore 81. The lower face of the valve body 80 contains a plurality of apertures, shown in FIGS. 3*a* and 3*b*, for communicating streams of gas into and out of the valve assembly. The role of these apertures in the operation of the main valve assembly will be discussed in greater detail below. The ends of the longitudinal bore 81 are closed by securing end caps 82 and 84 to the central valve body 80 with rubber gaskets 83 and 85 providing a pneumatic seal between the respective components of the housing. In addition to providing a pneumatic seal, these rubber gaskets provide a cushion for the valve spool as it moves between the open position shown in FIG. 3*a* and the closed position shown in FIG. 3*b*.

As can be seen in FIG. 2, the left end cap 82 has a cylindrical depression 86 in its inner face. In the assembled valve module, shown in cross-section in FIGS. 3*a* and 3*b*, this depression 86 forms a pressure chamber which serves as one of the pressure pilots for moving the valve spool within the assembly. A similar depression 88, shown in phantom in FIG. 2, forms a pressure chamber which serves as a pilot for the opposite side of the valve assembly. The pressure chamber 86, shown in FIGS. 3*a* and 3*b* corresponds to the pilot 36 shown schematically in the valve assembly 10 of FIG. 1. Likewise, the pressure chamber 88 corresponds to the schematic pilot 34 of FIG. 1. As can be seen in FIGS. 3*a* and 3*b*, the respective pilots are actually formed by the combination of a portion of the longitudinal bore 81 and the chambers 86 and 88. For purposes of discussion, however, these pressure chambers will be referred to as pressure chamber 86 or 88.

Two electronic solenoid exhaust valve actuators 90 and 92 are attached to the top of the main valve assembly to actuate the main valve pilots. Actuators of the type employed in the invention system are sold by Angar Scientific Corp. as model 410 subminiature solenoid exhaust valves. As can be seen in FIG. 2, actuator 92 has a threaded pneumatic connector 93 which is received in a threaded aperture 87 in the upper portion of endcap 82. The aperture 87 is connected to the pressure chamber formed by the cylindrical depression 86 via an internal channel 95 in the interior of endcap 82, as can be seen in FIGS. 3*a* and 3*b*. The threaded connector on actuator 91 is similarly received in threaded aperture 89, shown in phantom in FIG. 4, in endcap 84. The aperture 89 is connected to the chamber formed by cylindrical depression 88 by an internal channel 96 in endcap 84.

As can be seen in FIG. 2, each of the end caps 82 and 84 has a scallop, 82' and 84', respectively, in one upper corner to allow the actuator connected to the opposite end cap to be received in a very close-fitting relationship. The actuators of the preferred embodiment are attached to the assembly in a side-by-side mounting arrangement which allows the size of the module to be kept to a minimum.

The valve spool assembly 100 comprises a generally tubular central body core 101 with a plurality of transverse annular rings 102, 104, 106, 110, 112, and 114 in a spaced relation along the longitudinal axis of the body core 101. The diameter of the annular rings is slightly smaller than the diameter of the circular bore 81 of the central body 80 so that the spool assembly 100 can be slidably received therein. Four O-rings are received between selected pairs of the annular rings to define a system of pneumatic seals and passages which control the flow of gas streams within the valve assembly. As can be seen in FIGS. 3*a* and 3*b*, O-ring 103 is attached to the spool assembly in the depression between annular rings 102 and 104 to define a seal along the left outer circumferential edge of the spool assembly 100. Two O-rings, 107 and 109, are attached between annular rings 106 and 110 to provide a seal along the central portion of the spool. Finally, O-ring 113 is attached to the spool between annular rings 112 and 114 to provide a seal along the right outer circumferential edge of the spool.

As can be seen in FIGS. 3*a* and 3*b*, there is no O-ring between the annular rings 104 and 106. The space between these rings defines an annular pressure chamber 105 which is sealed by the O-rings 103 and 107 on either side of the chamber. Similarly, the space between the rings 110 and 112 defines an annular pressure chamber 111 which is sealed by O-rings 109 and 113. These annular pressure chambers cooperate with the apertures in the lower face of the valve body 80 to distribute gas streams through the valve assembly in a manner described below.

Referring again to FIGS. 3*a* and 3*b*, it can be seen that gas is distributed through the central body core 101 of the valve spool 100 via an internal channel comprising a central longitudinal bore 118 and transverse bore 119. Gas flowing through the longitudinal bore 118 is distributed to the chambers on either side of the spool through the apertures 116 and 116' of orifice fittings 115 and 115', respectively.

As was mentioned above, the lower face of the main valve body 80 contains a plurality of apertures for directing gas streams to and from the main valve assembly. Aperture 120 is connected to the output of the primary regulator module 14 and provides a 50 psi regulated gas stream into the valve assembly. Aperture 122 is connected to the main system; aperture 124 is the valve exhaust shown schematically by reference number 32 in FIG. 1; and aperture 126 is connected to the high pressure reset valve assembly 18.

With the spool 100 in the "OFF" position shown in FIG. 3*b*, the 50 psi gas stream from the primary regulator passes into the interior of the spool assembly through the path defined by aperture 120, annular pressure chamber 111 and internal channels 119 and 118. The gas stream then passes through the apertures 116 and 116' in orifice fittings 115 and 115', respectively, to pressurize the chambers on either side of the spool assembly 100. With the spool in this position, the chamber 88 on the right side of the spool will be at 50 psi, as will the chamber 86 on the left side of the spool. Since the spool has a pressure of 50 psi on both sides, it is in a balanced condition and does not move.

With the valve in the "OFF" position, the O-rings 107 and 109 provide a seal preventing the flow of 50 psi gas from aperture 120 to aperture 122, which is connected to the main system. Instead, the aperture 122 is connected via annular chamber 105 to the exhaust aperture 124.

To move the valve to the "ON" position to initiate the pressurization cycle, the electronic solenoid valve 92 is activated for a very short time interval to allow gas to be exhausted from pressure chamber 86 via channel 95. Since the gas is flowing into the chamber at a much slower rate than it is being exhausted, the pressure in this chamber drops very rapidly, thus creating a force imbalance on the spool 100. The higher pressure in the chamber 88 causes the spool 100 to move rapidly to the left, thereby causing the valve to be in the "ON" position shown in FIG. 3*a*.

With the valve spool 100 in the "ON" position shown in FIG. 3*a*, the 50 psi regulated gas stream from aperture 120 passes to the main system via the path defined by annular chamber 111 and aperture 122. The 50 psi also continues to flow into the interior of the valve spool 100 to repressurize each of the pilot chambers 86 and 88 to 50 psi to recreate the balanced force condition.

With the valve spool in the "ON" condition shown in FIG. 3*a*, the main valve can be turned off either electronically, by actuating the solenoid valve 90, or by action of the reset valve assembly 22. Electronic actuation of the solenoid valve 90 will cause the gas in the pilot chamber 88 to be exhausted via channel 96, thus causing a pressure imbalance which will move the valve spool to the right into the "OFF" position. Similarly, if the gas in the pilot 86 is exhausted through the reset valve via aperture 126, a pressure imbalance will be created which will move the valve spool 100 to the "OFF" position.

The invention electronically controlled pneumatic valve system offers numerous advantages over prior valve systems. It is extremely compact and lightweight so that it can easily be incorporated into portable pneumatic systems or other systems where size is of great concern. The system requires only a short pulse of electric current to turn the system "ON" and another short pulse to turn the system "OFF". This allows the system to be operated for a long period of time using only the current provided by a small battery pack. The gas pressure for the system is provided by a commerically available high-pressure carbon dioxide cylinder. Because of the efficiency of the valve assembly, such a cylinder contains sufficient gas to allow a system to be pressurized many times.

While the invention method and apparatus for providing an electronically controlled pneumatic switch has been described in connection with the preferred embodiment, it is not intended to limit the invention to the specific form set forth herein, but on the contrary, it is intended to cover such alternatives, modifications and equivalents as may included within the spirit and scope of the invention as defined by the appended claims.

We claim:

1. An electronically switched pneumatic valve system for use in portable inflation systems, comprising:

a valve housing, said housing having first and second ends and a central longitudinal bore extending from said first end to the second end thereof, said bore adapted to receive a valve member, said housing further comprising first and second apertures for communicating streams of gas into and out of said housing, respectively;

first and second endcaps second to said first and second ends, respectively, of said housing, said endcaps each having a depression therein, said depressions defining first and second pressure chambers at the respective ends of said housing when attached thereto, said first and second endcaps each comprising a scallop in an upper portion thereof;

a valve member slidably received within said longitudinal bore of said housing between said first and second pressure chambers, said valve member comprising a central tubular portion with at least four transverse annular rings attached to said tubular portion in spaced relation along a longitudinal axis thereof, the spaces between said four annular rings defining first and second outer annular chambers and an inner annular chamber, said inner annular chamber being in air flow communication with said first aperture of said housing, said valve member being movable between a first and a second position, said valve member defining a path for the flow of gas from said first aperture to said second aperture in said first position and blocking the flow of gas from said first aperture to said second aperture in said second position;

means for pressurizing and maintaining said first and second pressure chambers to a predetermined pressure, said means for pressurizing said pressure chambers comprising first and second air flow channels internal to said valve member, said first channel comprising a central disposed longitudinal bore along a longitudinal axis of said valve member, said longitudinal bore being in airflow communication with said first and second pressure chambers, said second channel comprising a transverse bore in said valve member, said transverse bore being alignable with said first aperture of said housing to receive a supply of regulated gas therethrough, said second channel being in air flow communication with said first channel to communicate said regulated gas stream thereto; and first and second electrically actuated solenoid exhaust valves in airflow communication with said first and second pressure chambers, respectively, said exhaust valves operable to change the pressure within said chambers temporarily to cause said valve element to move between said first position and said second position, a portion of the housing of said first exhaust valve being received in said scallop of said second endcap, and a portion of the housing of said second exhaust valve being received in the scallop of said first endcap, said first and second exhaust valves being disposed in a side-by-side close fitting relationship.

2. A valve system according to claim 1, said housing further comprising a third aperture in airflow communication with a pressure sensing means, said pressure sensing means comprising a pressure relief valve for causing a pressure drop in one of said pressure chambers in said housing, said pressure drop causing said valve means to move to said second position within said housing.

3. An electronically actuated pneumatic valve, comprising:

a valve housing, said housing having first and second ends and a central longitudinal bore extending from said first end to said second end thereof, said bore adapted to receive a valve member, said housing further comprising first and second apertures for communicating streams of gas into and out of said housing, respectively, and a third aperture in airflow communication with a pressure sensing means and a pressure relief valve;

first and second endcaps secured to said first and second ends, respectively, of said housing, said endcaps each having a depression therein, said depressions defining first and second pressure chambers at the respective ends of said housing when attached thereto, said first pressure chamber being in airflow communication with said third aperture of said housing and said pressure relief means, said endcaps further comprising scallops in upper portions thereof;

a valve member slidably received within said bore, said valve member comprising a tubular body portion having at least four annular rings attached thereto in spaced relation along a longitudinal axis thereof, the spaces between said rings defining first and second outer annular channels and an inner annular channel, said valve member being movable between a first position and a second position, said valve member defining a path for the flow of gas from said first aperture to said second aperture in said first position and blocking the flow of gas from said first aperture to said second aperture in said second position.

means for pressurizing and maintaining said first and second pressure chambers at a predetermined pressure, said pressurizing means comprising first and second airfow channels internal to said valve member, said first channel comprising a centrally disposed longitudinal bore along a longitudinal axis of said valve member, said longitudinal bore being in air flow communication with said first and second pressure chambers, said second channel comprising a transverse bore in said valve member, said transverse bore being alignable with said first aperture in said housing to receive a supply of regulated gas therethrough, said second channel being in airflow communication with said first channel to communicate said regulated gas stream therethrough; and first and second electrically actuated solenoid exhaust valves in air flow communication with said first and second pressure chambers, respectively, of said housing, said exhaust valves operable to temporarily change the pressure in the respective chambers to cause said valve element to move between said first position and said second position, said exhaust valves being mounted on said housing with a portion of each said exhaust valve being received in the scallop on the respective endplate on the opposite end of said housing.

* * * * *